United States Patent [19]

Nieuwkamp

[11] 4,125,226

[45] Nov. 14, 1978

[54] HOLLOW CONE NOZZLE FOR ATOMIZATION OF LIQUIDS

[75] Inventor: Wolfgang Nieuwkamp, Metzingen, Germany

[73] Assignee: Lechler Apparatebau KG, Germany

[21] Appl. No.: 725,771

[22] Filed: Sep. 23, 1976

[30] Foreign Application Priority Data

Sep. 23, 1975 [DE] Fed. Rep. of Germany ..... 2542240

[51] Int. Cl.[2] ..... B05B 1/34

[52] U.S. Cl. ..... 239/468; 239/491

[58] Field of Search ..... 239/466, 468, 469, 472, 239/491, 492

[56] References Cited

U.S. PATENT DOCUMENTS

| | | | |
|---|---|---|---|
| 2,428,748 | 10/1947 | Barz | 239/472 |
| 2,668,084 | 2/1954 | Saxton | 239/491 |
| 3,771,728 | 11/1973 | Polnauer | 239/468 |

FOREIGN PATENT DOCUMENTS

| | | | |
|---|---|---|---|
| 305,865 | 7/1971 | U.S.S.R. | 239/466 |

*Primary Examiner*—Robert W. Saifer

*Attorney, Agent, or Firm*—Craig & Antonelli

[57] ABSTRACT

A hollow cone nozzle for atomizing liquids, which is provided with a housing having a tangential inlet and a mouthpiece containing the nozzle discharge which is to be detachably fastened in the housing; a ring-shaped swirl insert with an opening disposed coaxial to the nozzle discharge and with several inlet channels directed transversely to the axis of the opening is thereby arranged in the nozzle housing between the inlet and the mouthpiece whereby the inlet channels of the swirl insert have cross sections that decrease in the flow direction.

39 Claims, 6 Drawing Figures

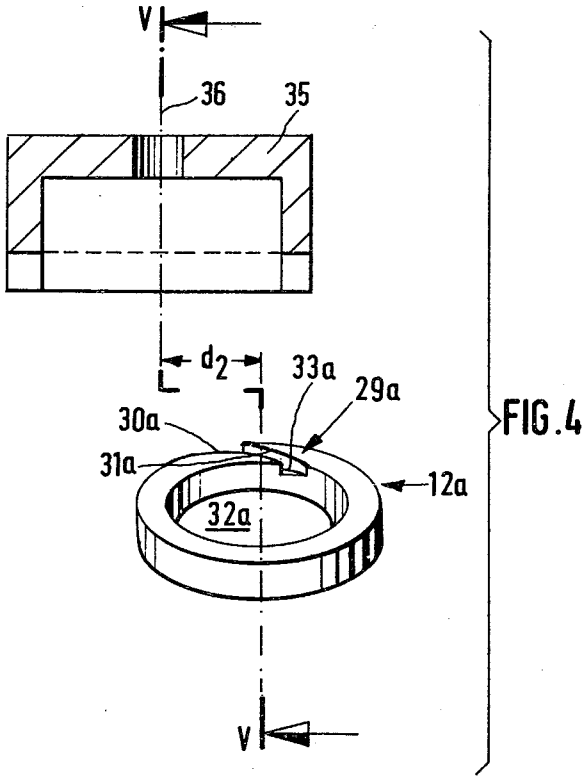
FIG.4
V
36
35
$d_2$
30a
31a
33a
29a
12a
32a
V
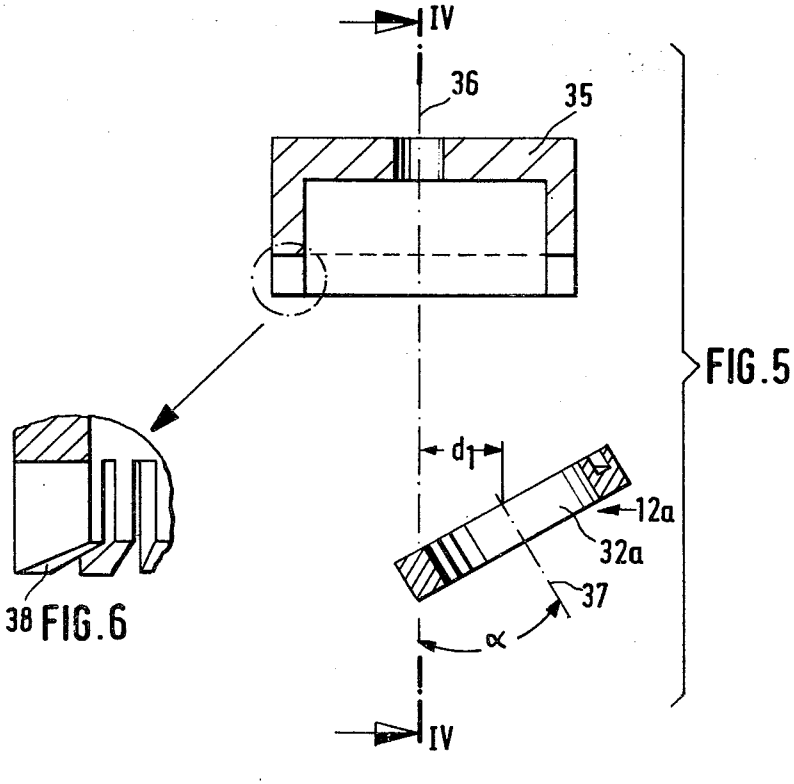
FIG.5
IV
36
35
$d_1$
12a
32a
37
α
IV
38
FIG.6

HOLLOW CONE NOZZLE FOR ATOMIZATION OF LIQUIDS

The present invention relates to a hollow cone nozzle for the atomization of liquids, with a housing provided with a tangential inlet and with a mouthpiece or nozzle containing the nozzle discharge, which is to be detachably fastened in the housing.

Areas of applications of such nozzles are, for example, the humdification of air, the moisting of textiles, dust filters and papers, the atomization of oil, tar and asphalt, the cooling and cleaning of air and of other gases as well as the re-cooling of hot steam and spray-drying. Of course, still other application areas which have not been mentioned hereinabove are also feasible.

Known in the prior art is, for example, a nozzle of the aforementioned type which consists of a two-partite nozzle housing with a tangential inlet and a mouthpiece, which is provided with a cylindrical nozzle discharge having a rounded-off outer side and a sharp-edged inner side. A swirl insert is not provided in this prior art nozzle.

Another nozzle utilized for the aforementioned purposes includes an axial inlet, an inner swirl insert which is constructed disk-shaped and is provided with diametrically oppositely disposed, inclined bores, as well as with a cylindrical nozzle discharge without external rounding-off.

Additionally, nozzles with an axial inlet, with a swirl insert having helically shaped grooves at the outer surface as well as with a cylindrical nozzle discharge having an outer conical beveling are also known in the art.

Finally, nozzles are known in the art for the aforementioned purposes whose mouthpiece consists of a deep-drawn metallic insert and which are provided with a tangential inlet. The nozzle discharge is formed by a central bore in the deep-drawn metallic insert.

The known nozzles entail the following considerable disadvantages: The through-flow quantity, the attack of the annular surface and the spray angle are determined empirically. Any influence on the spray angle is realized by a change of the bores and/or of the channel cross sections. Additionally, the prior art nozzles are characterized by a more or less large pressure- and energy-loss within the nozzle housing, which has a very disadvantageous effect as regards the energy to be applied, the size of the drops as well as the wear of the nozzle (cavitation). A further significant disadvantage of the known nozzles resides in that an exchange of the mouthpiece must take place for different pressure ranges and flow rates.

It is therefore the object of the present invention to provide a nozzle of the aforementioned type which is characterized by as small an energy loss as possible, and which is suitable without interchanging the mouthpiece for different pressure ranges and different flow rates. According to the basic concept of the present invention, this goal is attained essentially in that a ring-shaped swirl insert with a through-flow opening or passage disposed coaxial to the nozzle discharge and with several inlet channels directed transversely to the axis of this opening or passage is arranged in the nozzle housing between the inlet and the mouthpiece, and in that the inlet channels of the swirl insert are provided with a cross section that decreases in the flow direction.

As already indicated above, swirl inserts in nozzle housings are known as such in the prior art, however, this is not the case with nozzles having a tangential inlet, as are the subject of the present invention. Additionally, the known swirl inserts do not possess any inlet channels with maximum cross sections at the outer diameter of the insert and with cross sections decreasing uniformly toward the inner diameter. A regular circular distribution can be achieved in an advantageous manner by the aforementioned feature according to the present invention of the cross sections of the inlet channels decreasing uniformly in the flow direction. Additionally, the narrowing inlet channels are effective advantageously with respect to the aimed-at reduction of the pressure- and energy-losses within the nozzle.

According to another feature of the present invention, the inlet channels of the swirl insert are constructed to terminate tangentially or essentially tangentially from the outside into the cylindrical through-flow opening or passage of the swirl insert. Appropriately, the inlet channels of the swirl insert are groove-shaped, milled-in recesses with openings directed toward the mouthpiece so that the inner end face of the mouthpiece forms an axial boundary surface of the inlet channels.

According to one embodiment of the present invention, the groove-shaped inlet channels are each provided with rectilinear-parallel side surfaces and with a groove bottom inclined with respect to the end surfaces of the swirl insert. The feature according to the present invention of a uniform cross-sectional reduction of the inlet channel in the flow direction results therefrom in a simple manner. The rectilinear-parallel inlet channels can be manufactured in a simple and advantageous manner by milling with the use of a side-milling cutter or an end-milling cutter.

According to another particularly preferred embodiment of the present invention, the groove-shaped inlet channels are provided with curved parallel side surfaces having a curvature directed in the same sense as the curvature of the central passage or opening in the swirl insert, and the groove bottom of the inlet channels is constructed in each case inclined with respect to the end surfaces of the swirl insert. Such curved inlet channels can be produced by a cup-milling cutter whose axis is inclined with respect to the axis of the swirl insert. Appropriately, also the parallel side surfaces of the groove-shaped inlet channels are circularly curved, whereby the radius of curvature is greater than the radius of the central passage or opening of the swirl insert. An optimum deflection of the liquid stream which initially flows rectilinearly into the nozzle housing, into a circular movement inside of the swirl inset or of the adjoining nozzle discharge in the mouthpiece results from such a curved form of the inlet channels.

With respect to the actual construction, the present invention additionally proposes that the swirl insert engages in a corresponding recess of the nozzle housing and the inlet of the nozzle housing which decreases in cross section in the flow direction, adjoins an annular channel extending between the swirl insert and an inner nozzle housing wall. From the annular channel the liquid to be discharged through the nozzle can reach the tangential inlet channels of the swirl insert and from there can reach the nozzle discharge by way of the central opening of the swirl insert. The transition of the liquid from the annular channel into the inlet channels is favored according to a further feature of the present invention in that the axial dimension of the annular channel corresponds approximately to the initial groove depth of the groove-shaped inlet channels of the swirl insert and the cross section of the annular channel corresponds approximately to the sum of the initial cross sections of all inlet channels of the swirl insert.

A further important feature of the present invention which contributes considerably to the solution of the underlying problems is characterized in that the mouthpiece connected downstream of the swirl insert in the flow direction includes an inner and outer rounded-off nozzle discharge without cylindrical center section. It is thereby possible that the rounded-off nozzle discharge has the same radius at the inner and outer side or that two different radii of the rounded-off nozzle discharge are provided which approximately in the center thereof pass over tangentially into one another, i.e., without the formation of any edge.

Applicant has recognized on the basis of theoretical considerations and practical tests that the prejudice which existed heretofore among the experts, namely that a nozzle discharge has to be constructed cylindrically at least within its center area, is not justified. Instead, the energy loss inside of the nozzle can be reduced to a minimum by the completely rounded-off construction of the nozzle discharge in accordance with the present invention, as a result of which, on the one hand, large drop dimensions are avoided. On the other hand, such a mouthpiece is more suitable for larger ranges of pressures and flow rates than the mouthpieces of the known nozzles. With the nozzle according to the present invention, only the swirl insert but not the mouthpiece has to be interchanged with a larger pressure change.

A further feature of the present invention resides in that the outer radius of the rounded-off nozzle discharge passes over tangentially into a conical bevelling. By the selection of a sufficiently large discharge radius, it is advantageously possible to attain the desired spray angle exclusively by a change of the cone angle of the conical bevelling.

Of course, it is also possible and appropriate with the nozzle according to the present invention to provide a ring-shaped recess or groove directly surrounding the nozzle discharge for producing a discontinuity or separation edge. However, the present invention provides in that respect that the ring-shaped recess or groove has a rounded-off cross section at the nozzle discharge under formation of a separating edge whereby the ring-shaped recess or groove can be constructed either approximately semi-circularly shaped in cross section or undercutting the nozzle discharge. It is achieved thereby that the air torn along by the outer surface of the liquid cone is able to flow freely, i.e., with smallest possible friction, into the ring-shaped recess or groove during the deflection.

A further reduction of the energy and pressure loss inside the nozzle housing in the sense of the problem with which the invention deals can be achieved according to a further feature of the present invention in that the nozzle housing is provided internally with a conical protuberance which is arranged coaxially to the opening in the swirl insert and to the nozzle discharge. Such conically shaped protuberances are known as such in nozzles, but not for the purpose of the present invention. In the prior art nozzles, the protuberance serves for the uniform circular distribution of the liquid. The applicant has now recognized that by a suitable construction of the conical protuberance, cavitation damages at the housing as well as pressure and energy losses can be avoided. A cone angle of the protuberance of approximately 120° has proved thereby as appropriate.

These and further objects, features and advantages of the present invention will become more apparent from the following description when taken in connection with the accompanying drawing which shows, for purposes of illustration only, two embodiments in accordance with the present invention, and wherein:

FIG. 4 is a perspective view of another embodiment of a swirl insert in accordance with the present invention together with the mechanism for manufacturing the inlet channels of the swirl insert, with the cross section taken along line IV—IV in FIG. 5;

FIG. 5 is a cross-sectional view taken along line V—V in FIG. 4; and

FIG. 6 is a partial cross-sectional view, on an enlarged scale, illustrating the detail A of FIG. 5.

Figure 1:
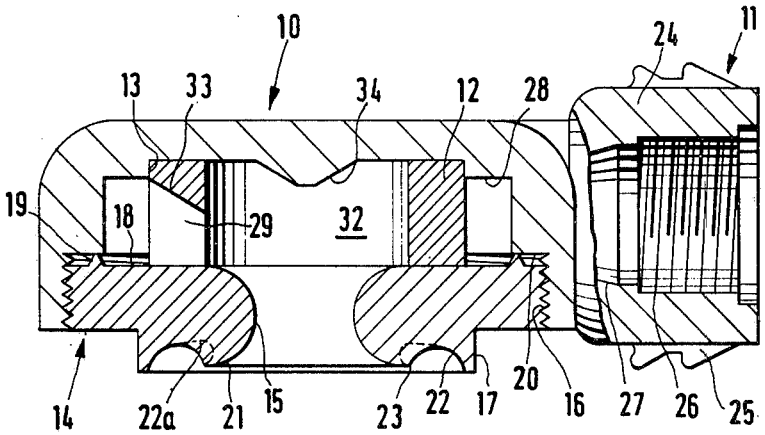
FIG. 1 is a vertical cross-sectional view through one embodiment of a hollow cone nozzle according to the present invention.
Figure 2:
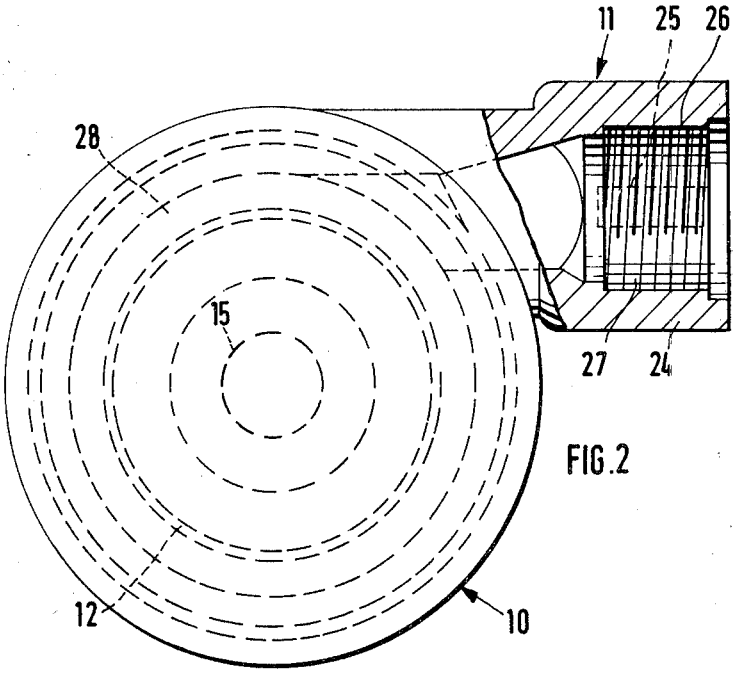
FIG. 2 is a plan view on the nozzle according to FIG. 1, partially in horizontal cross section.
Figure 3:
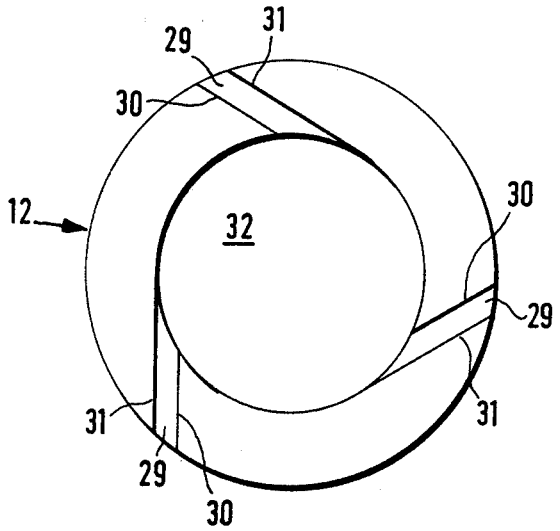
FIG. 3 is a plan view on the swirl insert as used in the nozzle according to FIGS. 1 and 2.

Referring now to the drawing wherein like reference numerals are used throughout the various views to designate like parts, and more particularly to FIGS. 1 and 2, reference numeral 10 generally designates in these figures the housing of a hollow cone nozzle with a tangential inlet generally designated by reference numeral 11. A ring-shaped swirl insert 12 is arranged in the housing 10 which can be seen in plan view from FIG. 3. The swirl insert 12 is inserted into a corresponding recess 13 and is retained in the housing 10 by a nozzle mouthpiece generally designated by reference numeral 14 which includes the nozzle discharge designated by reference numeral 15. The housing includes, for that purpose, a threaded bore 16, into which the mouthpiece 14 is screwed by means of a corresponding external thread. The screwing-in can take place by means of flattened off side surfaces 17 of the mouthpiece and a suitable wrench.

As can be seen from FIG. 1, the mouthpiece 14 includes a circumferential sealing edge 19 triangular in cross section which faces the swirl insert 12 and abuts the mouthpiece surface 18 at the swirl insert 12; as the mouthpiece 14 is screwed-in, the sealing edge 19 penetrates into an offset or shoulder 20 of the housing nozzle 10 and therewith closes off sealingly the interior space of the nozzle housing 10.

As can be further seen from FIG. 1, the nozzle discharge 15 has a completely rounded-off shape in cross section, i.e., is without cylindrical intermediate section, which passes over into a conical form or shape only in the outermost discharge area 21. Furthermore, FIG. 1 illustrates that the nozzle discharge 15, 21 is surrounded by a ring-shaped groove 22 which is provided with a rounded-off shape under formation of a separating edge 23 at the nozzle discharge, whence a low friction inflow of outside air to the hollow cone spray jet is assured. The ring-shaped, machined-in groove 22 may also be so constructed that — as indicated in dash lines **22*a* in FIG. 1 — it undercuts the nozzle discharge 15, 21**.

The nozzle described hereinabove can be connected by means of a short connecting stub 24 either in the transverse or in the longitudinal direction to a pipe conducting therethrough the liquid. For purposes of fastening in the transverse direction of the pipe serve cams 25 at the short connecting piece 24, at which a suitable clamping mechanism can engage. For purposes of connection to a pipe in the longitudinal direction, the connecting stub 24 includes an internal thread 26.

The liquid to be atomized reaches from the connecting pipe (not shown) in a tangential direction (see FIG. 2), a ring-shaped inner space of the nozzle housing 10 which is designated by reference numeral 28 by way of a bore 27. As can be seen in particular from FIG. 3, the swirl insert 12 includes three groove-shaped, milled-in recesses 29 which have parallel side walls 30 and 31 and terminate approximately tangentially in the interior space of the ring-shaped swirl insert 12 which is designated by reference numeral 32. It can be seen from the cross-sectional view of the swirl insert 12 in FIG. 1 that the groove-shaped milled-in portions 29 which form the inlet channels from the annular space 28 of the nozzle housing to the inner space 32 of the swirl insert 12, have a suitable groove bottom 33. The liquid to be sprayed or atomized is therefore accelerated during passage through the inlet channels 29 by reason of the cross section thereof which decreases in the inward direction. Pressure losses and cavitation damages are avoided thereby. This effect is enhanced by a conical protuberance 34 of the nozzle housing 10 which projects into the interior space 32 of the swirl insert 12. The already mentioned inner end surface 18 of the mouthpiece 14 forms the lower boundary both of the ring-shaped housing space 28 as also of the inlet channels 29 in the swirl insert 12, whereby the mouthpiece 14 simultaneously therewith fixes the swirl insert 12 within the nozzle housing 10. The liquid which is in rotation in the interior space 32 of the swirl insert 12 finally reaches the atmosphere as hollow cone spray by way of the rounded-off discharge nozzle.

Another embodiment of a swirl insert for the nozzle housing 10 is illustrated in FIGS. 4 and 5. The swirl insert according to FIGS. 4 and 5 is also constructed ring-shaped and is generally designated by reference numeral 12*a*. It differs from the swirl insert 12 according to FIGS. 1 to 3 exclusively by the configuration of the inlet channels of which one is illustrated in FIG. 4 and is designated therein by reference numeral 29*a*. Appropriately, the swirl insert 12*a* is also provided with several, for example, three inlet channels 29*a*; for the sake of simplicity, however, only one inlet channel 29 is shown in FIG. 4. The inlet channel 29*a* according to FIG. 4 includes — similar as with the swirl insert 12 according to FIGS. 1 to 3 — an inclined groove bottom 33*a* so that also in this case there results a cross-sectional decrease of the inlet channel 29 and therewith a corresponding acceleration of the liquid which flows in from the outside toward the inside. However, differing from the embodiment of the inlet channels 29 according to FIGS. 1 to 3, the inlet channel 29*a* is so constructed and shaped that both of its side walls 30*a* and 31*a* have a curved configuration curved in the sense of the internal bore of the swirl insert 12*a*. A feed of the liquid, which exhibits still lower losses, from the annular channel 28 of the nozzle housing (FIG. 1) through the inlet channels 29*a* into the interior space 32*a* of the swirl insert 12*a* is made possible thereby.

The manufacture of such curved inlet channels 29*a* is also illustrated in FIGS. 4 to 6. The milling-in of the inlet channels 29*a* takes place by means of a cup-milling cutter 35 whose center axis 36 is inclined with respect to the center axis 37 of the swirl insert 12*a* by an angle $\alpha$ (FIG. 5). Additionally, the axes 36 and 37 of the cup-milling cutter 35 and of the swirl insert 12*a* are so offset with respect to one another that a spacing $d_1$ will result in one plane (FIG. 5) and a spacing $d_2$ in the other plane (FIG. 4). In order to impart to the inlet channel 29*a* a rectangular cross section at the outer circumference of the swirl insert 12*a*, the cup milling cutter 35 is provided with inclined teeth 38—as can be seen from FIG. 6.

While I have shown and described only two embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A hollow cone nozzle for atomizing liquids, comprising a housing means provided with a substantially tangential inlet means and a mouthpiece containing a nozzle discharge and operable to be detachably secured in the housing means, characterized in that a ring-shaped swirl insert means is arranged in the nozzle housing means having a central opening disposed substantially coaxial to the nozzle discharge and being provided with several inlet channel means directed substantially transversely to the axis of the opening, and in that the inlet channel means of the swirl insert means have a cross section decreasing in the flow direction, and further characterized in that the inlet channel means of the swirl insert means are constructed so as to terminate at least essentially tangentially from the outside into the substantially cylindrical opening, in that the inlet channel means of the swirl insert means are groove-shaped, milled-in recesses with openings directed toward the mouthpiece so that the inner end surface of the mouthpiece forms an axial boundary surface of the inlet channel means.

2. A hollow cone nozzle according to claim 1, characterized in that the groove-shaped inlet channel means are provided with substantially rectilinear-parallel side surfaces and a groove bottom inclined with respect to the end surfaces of the swirl insert means.

3. A hollow cone nozzle according to claim 1, characterized in that the groove-shaped inlet channel means are provided with curved-parallel side surfaces having a curvature directed in the same sense as the curvature of the central opening and in that the groove bottom of the inlet channel means is constructed inclined with respect to the end surfaces of the swirl insert means.

4. A hollow cone nozzle according to claim 3, characterized in that the parallel side surfaces of the groove-shaped inlet channel means are substantially circularly curved, whereby the radius of curvature thereof is larger than the radius of the central opening of the swirl insert means.

5. A hollow cone nozzle according to claim 1, characterized in that the swirl inset means engages in a corresponding recess of the nozzle housing means and in that the inlet means of the nozzle housing means which decreases in cross section in the flow direction, adjoins an annular channel extending between the swirl insert means an an inner nozzle housing wall.

6. A hollow cone nozzle according to claim 5, characterized in that the axial dimension of the annular channel corresponds approximately to the initial groove depth of the groove-shaped inlet channel means of the swirl insert means and the cross section of the annular channel corresponds approximately to the sum of the initial cross sections of all inlet channel means of the swirl insert means.

7. A hollow cone nozzle according to claim 5, characterized in that the mouthpiece connected downstream of the swirl insert means, as viewed in the flow direction, includes an inner and outer rounded-off nozzle discharge substantially devoid of any cylindrical center section.

8. A hollow cone nozzle according to claim 7, characterized in that the rounded-off nozzle discharge has the same radius of curvature at the inside and outside thereof.

9. A hollow cone nozzle according to claim 7, characterized in that the radii of the rounded-off nozzle discharge pass over approximately in the center thereof tangentially into one another and thus substantially without any edge formation.

10. A hollow cone nozzle according to claim 9, characterized in that the outer radius of the rounded-off nozzle discharge passes over tangentially into a conical bevelling.

11. A hollow cone nozzle according to claim 10, with a ring-shaped groove directly surrounding the nozzle discharge, characterized in that the ring-shaped groove has a rounded-off cross section at the nozzle discharge under formation of a separating edge.

12. A hollow cone nozzle according to claim 11, characterized in that the ring-shaped groove is constructed approximately semi-circularly shaped in cross section.

13. A hollow cone nozzle according to claim 11, characterized in that the nozzle discharge is undercut by the ring-shaped groove rounded-off in cross section.

14. A hollow cone nozzle according to claim 11, characterized in that the swirl insert means is fixed in the nozzle housing means by the mouthpiece axially abutting thereat.

15. A hollow cone nozzle according to claim 14, characterized in that the mouthpiece with its inner end surface forms at the same time the lower boundary of the annular channel in the nozzle housing means.

16. A hollow cone nozzle according to claim 15, characterized in that the mouthpiece is sealingly screwed into a threaded bore provided in the nozzle housing means which is substantially concentric to the annular channel, exceeds the same in diameter and is offset step-shaped with respect to the same.

17. A hollow cone nozzle according to claim 16, characterized in that the mouthpiece is provided on its inner end face forming the abutment surface for the swirl insert means with a sealing edge which is substantially triangular in cross section, said sealing edge having a larger diameter than the annular chamber disposed substantially concentric thereto and being in sealing engagement with a step-shaped offset of the nozzle housing means.

18. A hollow cone nozzle according to claim 16, characterized in that the nozzle housing means is provided internally with a substantially conical protuberance which is arranged substantially coaxially to the opening in the swirl insert means and to the discharge of the nozzle.

19. A hollow cone nozzle according to claim 18, characterized in that the protuberance has a cone angle of about 120°.

20. A hollow cone nozzle for atomizing liquids, comprising a housing means provided with a substantially tangential inlet means and a mouthpiece containing a nozzle discharge and operable to be detachably secured in the housing means, characterized in that a ring-shaped swirl insert means is arranged in the nozzle housing means between the inlet means and the mouthpiece, said swirl insert means having a central opening disposed substantially coaxial to the nozzle discharge and being provided with several inlet channel means directed substantially transversely to the axis of the opening, and in that the inlet channel means of the swirl insert means have a cross section decreasing in the flow direction, and further characterized in that the inlet channel means of the swirl insert means are groove-shaped recesses with openings directed toward the mouthpiece so that the inner end surface of the mouthpiece forms an axial boundary surface of the inlet channel means.

21. A hollow cone nozzle according to claim 20, characterized in that the groove-shaped inlet channel means are provided with substantially rectilinear-parallel side surfaces and a groove bottom inclined with respect to the end surfaces of the swirl insert means.

22. A hollow cone nozzle according to claim 20, characterized in that the groove-shaped inlet channel means are provided with curved-parallel side surfaces having a curvature directed in the same sense as the curvature of the central opening and in that the groove bottom of the inlet channel means is constructed inclined with respect to the end surfaces of the swirl insert means.

23. A hollow cone nozzle according to claim 22, characterized in that the parallel side surfaces of the groove-shaped inlet channel means are substantially circularly curved, whereby the radius of curvature thereof is larger than the radius of the central opening of the swirl insert means.

24. A hollow cone nozzle for atomizing liquids, comprising a housing means provided with a substantially tangential inlet means and a mouthpiece containing a nozzle discharge and operable to be detachably secured in the housing means, characterized in that a ring-shaped swirl insert means is arranged in the nozzle housing means between the inlet means and the mouthpiece, said swirl insert means having a central opening disposed substantially coaxial to the nozzle discharge and being provided with several inlet channel means directed substantially transversely to the axis of the opening, and in that the inlet channel means of the swirl insert means have a cross section decreasing in the flow direction, and further characterized in that the swirl insert means engages in a corresponding recess of the nozzle housing means and in that the inlet means of the nozzle housing means adjoins an annular channel extending between the swirl insert means and an inner nozzle housing wall.

25. A hollow cone nozzle according to claim 24, characterized in that the axial dimension of the annular channel corresponds approximately to the initial groove depth of the groove-shaped inlet channel means of the swirl insert means and the cross section of the annular channel corresponds approximately to the sum of the initial cross sections of all inlet channel means of the swirl insert means.

26. A hollow cone nozzle for atomizing liquids, comprising a housing means provided with a substantially tangential inlet means and a mouthpiece containing a nozzle discharge and operable to be detachably secured in the housing means, characterized in that a ring-shaped swirl insert means is arranged in the nozzle housing means between the inlet means and the mouthpiece, said swirl insert means having a central opening disposed substantially coaxial to the nozzle discharge and being provided with several inlet channel means directed substantially transversely to the axis of the opening, and in that the inlet channel means of the swirl insert means have a cross section decreasing in the flow direction, with a ring-shaped groove directly surrounding the nozzle discharge, characterized in that the ring-shaped groove has a rounded-off cross section at the nozzle discharge under formation of a separating edge.

27. A hollow cone nozzle according to claim 26, characterized in that the ring-shaped groove is constructed approximately semi-circularly shaped in cross section.

28. A hollow cone nozzle according to claim 26, characterized in that the nozzle discharge is undercut by the ring-shaped groove rounded-off in cross section.

29. A hollow cone nozzle for atomizing liquids, comprising a housing means provided with a substantially tangential inlet means and a mouthpiece containing a nozzle discharge and operable to be detachably secured in the housing means, characterized in that a ring-shaped swirl insert means is arranged in the nozzle housing means between the inlet means and the mouthpiece, said swirl insert means having a central opening disposed substantially coaxial to the nozzle discharge and being provided with several inlet channel means directed substantially transversely to the axis of the opening, and in that the inlet channel means of the swirl insert means have a cross section decreasing in the flow direction, characterized in that the swirl insert means is fixed in the nozzle housing means by the mouthpiece axially abutting thereat, and in that the mouthpiece is sealingly screwed into a threaded bore provided in the nozzle housing means which is substantially concentric to the annular channel, exceeds the same in diameter and is offset step-shaped with respect to the same.

30. A hollow cone nozzle according to claim 29, characterized in that the mouthpiece is provided on its inner end face forming the abutment surface for the swirl insert means with a sealing edge which is substantially triangular in cross section, said sealing edge having a larger diameter than the annular channel disposed substantially concentric thereto and being in sealing engagement with a step-shaped offset of the nozzle housing means.

31. A hollow cone nozzle for atomizing liquids, comprising a housing means provided with a substantially tangential inlet means and a mouthpiece containing a nozzle discharge and operable to be detachably secured in the housing means, characterized in that a ring-shaped swirl insert means is arranged in the nozzle housing means between the inlet means and the mouthpiece, said swirl insert means having a central opening disposed substantially coaxial to the nozzle discharge and being provided with several inlet channel means directed substantially transversely to the axis of the opening, and in that the inlet channel means of the swirl insert means have a cross section decreasing in the flow direction, and further characterized in that the nozzle housing means is provided internally with a substantially conical protuberance which is arranged substantially coaxially to the opening in the swirl insert means and to the discharge of the nozzle.

32. A hollow cone nozzle according to claim 31, characterized in that the protuberance has a cone angle of about 120°.

33. A hollow cone nozzle suitable for several through-flow rates for the atomization of a liquid and comprising a housing having a tangential inlet, a vortex insert, and a mouthpiece detachably attached in the housing and containing a nozzle outlet, characterized in that the vortex insert is arranged in the nozzle housing between the inlet and the mouthpiece and is of an annular configuration comprising a passage opening disposed coaxially with respect to the nozzle outlet and several feed ducts extending transversely to the axis of the passage opening, said feed ducts of the vortex insert having a cross section which decreases in the flow direction, and further characterized in that the feed ducts of the vortex insert terminate tangentially or substantially tangentially from the outside into the cylindrical passage opening and are in the form of groove-shaped milled-in elements with openings oriented toward the mouthpiece so that the inner end face of the mouthpiece constitutes an axial limiting surface of the feed ducts.

34. A hollow cone nozzle according to claim 32, characterized in that the mouthpiece connected downstream of the swirl insert means, as viewed in the flow direction, includes an inner and outer rounded-off nozzle discharge substantially devoid of any cylindrical center section.

35. A hollow cone nozzle according to claim 34, characterized in that the rounded-off nozzle discharge has the same radius of curvature at the inside and outside thereof.

36. A hollow cone nozzle according to claim 34, characterized in that the radii of the rounded-off nozzle discharge pass over approximately in the center thereof tangentially into one another and thus substantially without any edge formation.

37. A hollow cone nozzle according to claim 34, characterized in that the outer radius of the rounded-off nozzle discharge passes over tangentially into a conical bevelling.

38. A hollow cone nozzle according to claim 26, characterized in that the swirl insert means is fixed in the nozzle housing means by the mouthpiece axially abutting thereat.

39. A hollow cone nozzle according to claim 26, characterized in that the mouthpiece with its inner end surface forms at the same time the lower boundary of the annular channel in the nozzle housing means.

* * * * *